United States Patent [19]

Welling, Jr.

[11] Patent Number: 4,997,308

[45] Date of Patent: Mar. 5, 1991

[54] PAVING STONE

[76] Inventor: Robert L. Welling, Jr., 141 Todd Rd., Freeport, Pa. 16229

[21] Appl. No.: 399,815

[22] Filed: Aug. 29, 1989

[51] Int. Cl.[5] ..... E01C 5/00

[52] U.S. Cl. ..... 404/38; 52/603

[58] Field of Search ..... 404/37–39, 404/41, 42, 34; 52/608, 603, 605

[56] References Cited

U.S. PATENT DOCUMENTS

| | | | |
|---|---|---|---|
| 529,747 | 11/1894 | Perrody | 404/39 X |
| 1,379,440 | 5/1921 | Brainerd | 404/34 |
| 1,673,630 | 6/1928 | Madge | 404/39 X |
| 3,746,458 | 7/1973 | Alloca | 404/37 |
| 3,891,340 | 6/1975 | Bolli | 404/38 |
| 3,897,164 | 7/1975 | Dodino | 404/41 |
| 4,128,357 | 12/1978 | Barth et al. | 404/41 |
| 4,544,305 | 10/1985 | Hair | 404/41 |

FOREIGN PATENT DOCUMENTS

| | | | |
|---|---|---|---|
| 7409912 | 6/1974 | Fed. Rep. of Germany . | |
| 748927 | 7/1933 | France | 404/34 |
| 1073200 | 9/1954 | France . | |
| 8041 | of 1839 | United Kingdom | 404/41 |

*Primary Examiner*—Stephen J. Novosad

*Attorney, Agent, or Firm*—Webb, Burden, Ziesenheim & Webb

[57] ABSTRACT

A paving stone of a square block including four lateral edges, four angled corners and a central hole. The four lateral edges of the square block each have a v-shaped notch formed therein mesial the angled corners. The paving stone also including a plurality of groove-like recesses extending between the corner of the v-shaped notches and the corners of said central square hole to form a paving stone having the appearance of four separate octagons.

19 Claims, 5 Drawing Sheets

PAVING STONE

BACKGROUND OF THE INVENTION

1. Field of the Invention

This invention relates to paving stones. More particularly, this invention relates to a paving stone having the appearance of four connected octagonal shaped paving stones having a square hole at the center capable of being laid with other like paving stones to form a stable load carrying surface.

2. Description of the Prior Art

Paving stones of differing shapes have been employed in the construction of traffic-carrying surfaces such as roadways, footways, embankments and pool decks. Typically, the paving stones are made of concrete which is formed in a desired shape in a mold, and then cured under high pressure where the concrete is compacted and hardened. The hardened paving stone is then removed from the mold and exposed to ambient air to cure. The method by which such paving stones can be made is well known in the art and forms no part of my invention. Hence, methods for making paving stones will not be addressed further except to note that the shape of the various molds used to form prior art paving stones must be modified so as to conform to the shape of my paving stone.

In laying the paving stones, the under-surface is first prepared in a known fashion to provide a smooth, flat surface. The paving stones are then placed on the under-surface such that their vertical or peripheral walls or lateral edges come into close contact. The gaps between the lateral edges may be filled either with mortar, concrete, or other such solidifying spacer elements, or, preferably, with sand which is simply poured into the gaps in a known manner. The traffic load encountered by surfaces constructed in the above manner can vary from as light as pedestrian traffic to as heavy as several ton trucks and forklifts.

Known paving stones come in a wide variety of shapes from square and rectangular to multi-sided and irregular. Among the known paving stones when viewed from the top include paving stones which have a simple geometric shape such as a rectangle, a square, a hexagon, or an octagon. These paving stones are less desirable than other types of stones hereinafter discussed because their shapes preclude an interlock joint between adjacent paving stones. Additionally, proper utilization can require greater material and care than other paving stones and are often not satisfactory in use. For example, if such paving stones were placed in the manner expected of my invention, i.e., with sand between them, the surface would not be stable because there is no interlock. Furthermore, because there is no interlock, long, straight channels are more easily formed between the elements, thus, permitting rain, for example, to wash away the sand further reducing the load carrying stability of the ground cover formed with those elements. Hence, such paving stones would typically require mortar or concrete between elements. Mortar or concrete is typically more expensive than sand and is more difficult to work with. One example of a known and simple geometric shape paving stone is French Patent No. 1.073.200.

Another type of paving stone is one wherein, from a top plan view, the paving stone looks substantially rectangular but the edges are deformed in such a manner as to interlock when laid next to an adjacent, identical stone. An example of this type of paving stone is shown in U.S. Pat. No. 1,379,440. Also included in this type of paving stone are multi-faced irregularly shaped paving stones. The paving stones of this type overcome some of the drawbacks of paving stones discussed in the preceding paragraph because they may be interlocked. However, they are less attractive from an aesthetic standpoint. Moreover, these paving stones generally may not be intermixed with other differently shaped paving stones, as would be possible with paving stones described in the preceding paragraph to permit a wide variety of patterns to be created.

Yet another type of paving stone includes two or more sections having a simple geometric shape which are combined into one integral paving stone. Examples of such paving stones are disclosed in U.S. Pat. Nos. 4,544,305; 4,128,357; and German Gebrauchsmuster No. 7,409,912. The primary advantage of such an integral paving stone is that it can interlock for durability and stability.

Accordingly, it is an object of the present invention to provide a paving stone that is simple and economical to manufacture. Another object of the present invention is to provide a paving stone that is easy to lay in a running bond pattern, a modified running bond pattern, a stack bond pattern or a basket weave pattern. Yet another object of the present invention is to provide a paving stone that may incorporate a separate colored paving stone to provide a wide variety of mosaic designs. Another object of the present invention is to provide a paving stone having a central hole to impart an appearance to the single paving stone of four separate octagonal shaped paving stones. Yet another object of the present invention is to provide a paving stone with a central hole to facilitate hand gripping and the use of a mechanized handling system and/or a mechanized laying system. Another object of the present invention is to provide a paving stone that may be laid upon a suitable foundation and interlocked with adjacent paving stones in a running bond pattern to form a unitary surface.

SUMMARY OF THE INVENTION

Briefly, according to this invention, there is provided a paving stone of a square block shape. The square block has four angled corners, four lateral edges and a central hole. Each lateral edge has a v-shaped notch positioned between the angled corners of the block. In a preferred embodiment, the central hole is square-shaped and a groove extends between the central square hole and each v-shaped notch such that a paving stone is formed having the appearance of four octagons.

BRIEF DESCRIPTION OF THE DRAWINGS

Further features and other objects and advantages of this invention will become clear from the following detailed description made with reference to the drawings in which.

DESCRIPTION OF THE PREFERRED EMBODIMENTS

Figure 1:
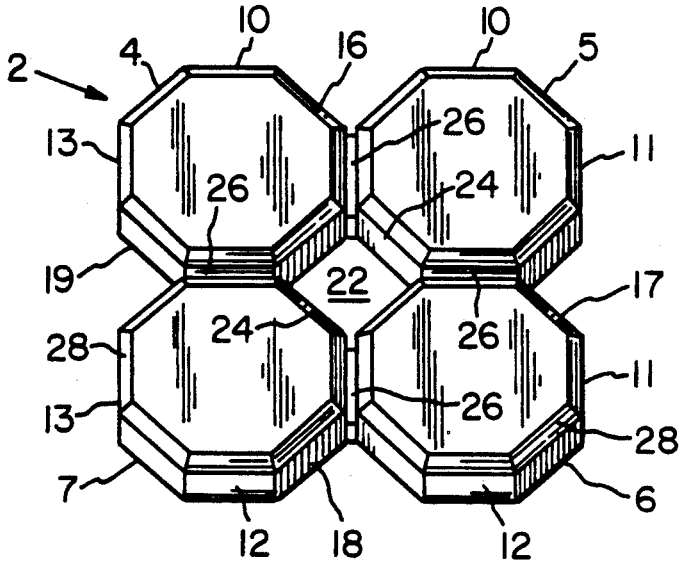
FIG. 1 is a front perspective view of a first embodiment of a paving, stone in accordance with the present invention.
Figure 2:
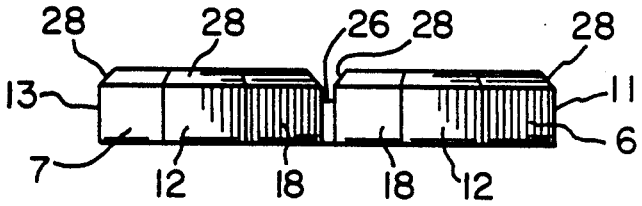
FIG. 2 is a front elevational view of the paving stone of FIG. 1.

Referring to the drawings, wherein like reference characters represent like elements, FIGS. 1–5 show a paving stone 2 in accordance with a first embodiment of the present invention. The paving stone is generally of the shape of a square having four angled corners 4, 5, 6 and 7 and four lateral edges 10, 11, 12 and 13. The corners 4–7 are preferably angled at approximately 45°. Each of the four lateral edges 10–13 has a v-shaped notch 16, 17, 18 and 19, respectively, formed therein between the angled corners 4–7 of the square-shaped paving stone 2. One side of each v-shaped notch 16–19 is of a length equivalent to the length of an angled corner 4–7.

Figure 3:
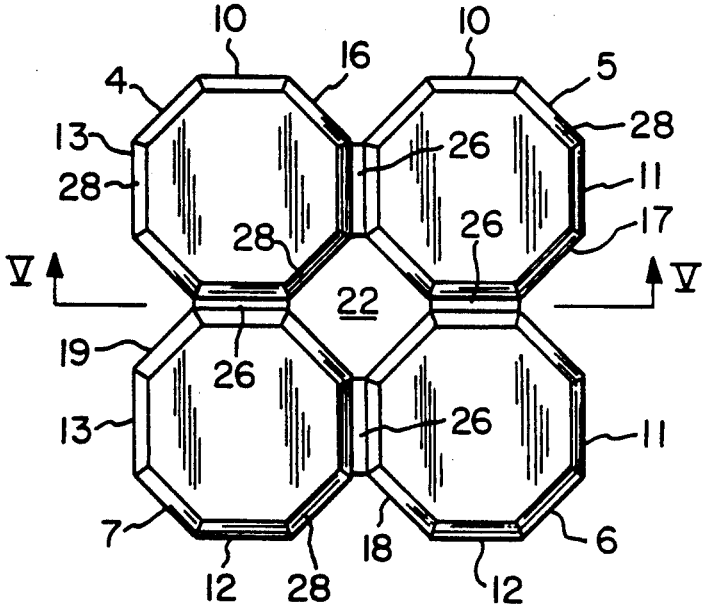
FIG. 3 is a top plan view of the paving stone of FIG. 1.
Figure 4:
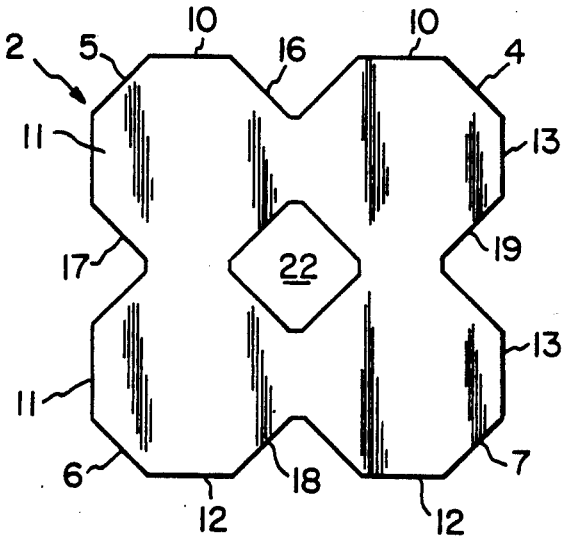
FIG. 4 is a bottom plan view of the paving stone of FIG. 1.
Figure 5:
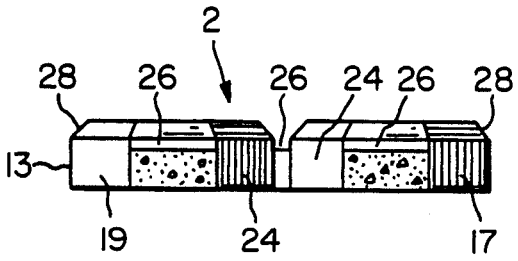
FIG. 5 is a section taken along lines V—V in FIG. 3.

As shown in FIGS. 1, 3 and 4, a hole 22 is formed within the center of the paving stone 2. The hole 22 may be of any shape and size as long as the hole 22 may be partitioned into identical quarter sections such that each quarter section is a mirror image of the shape of the closest diagonal corner of the paving stone 2 and two combined quarter sections are a mirror image of the notches in the lateral edges. For example, the hole 22 may be round and the corners of the paving stone 2 may be quarter round and the notch may be half round. The hole 22 as shown in FIGS. 1–7 is square-shaped having a lateral edge 24 of a length approximately equivalent to the length of the angled corners 4–7 formed in the paving stone 2. The position of the square hole 22 is preferably rotated approximately 45° from a line formed by the lateral edges 10–13 of the paving stone 2, such that the square hole 22 appears as a diamond shape within the larger square paving stone. It will be appreciated that the hole 22 allows for the mechanized handling and mechanized laying of paving stones 2 without the need to only grasp the lateral edges 10–13 of the paving stones.

In a preferred embodiment of the present invention, groove-like recesses 26 extend between each corner of the square hole 22 and each corner of an adjacent v-shaped notch 16–19. The groove-like recesses 26, square hole 22, angled corners 4–7 and lateral edges 10–13, each having a v-shaped notch 16–19, cooperatively provide an appearance to the paving stone 2 of four separate octagonal paving stones. The groove-like recesses 26 may be of any width. In a preferred embodiment, the groove-like recesses 26 are of a width corresponding to the width of the subsequent laying or paving gaps between adjacent paving stones 2 laid in compound arrangements.

Figure 6:
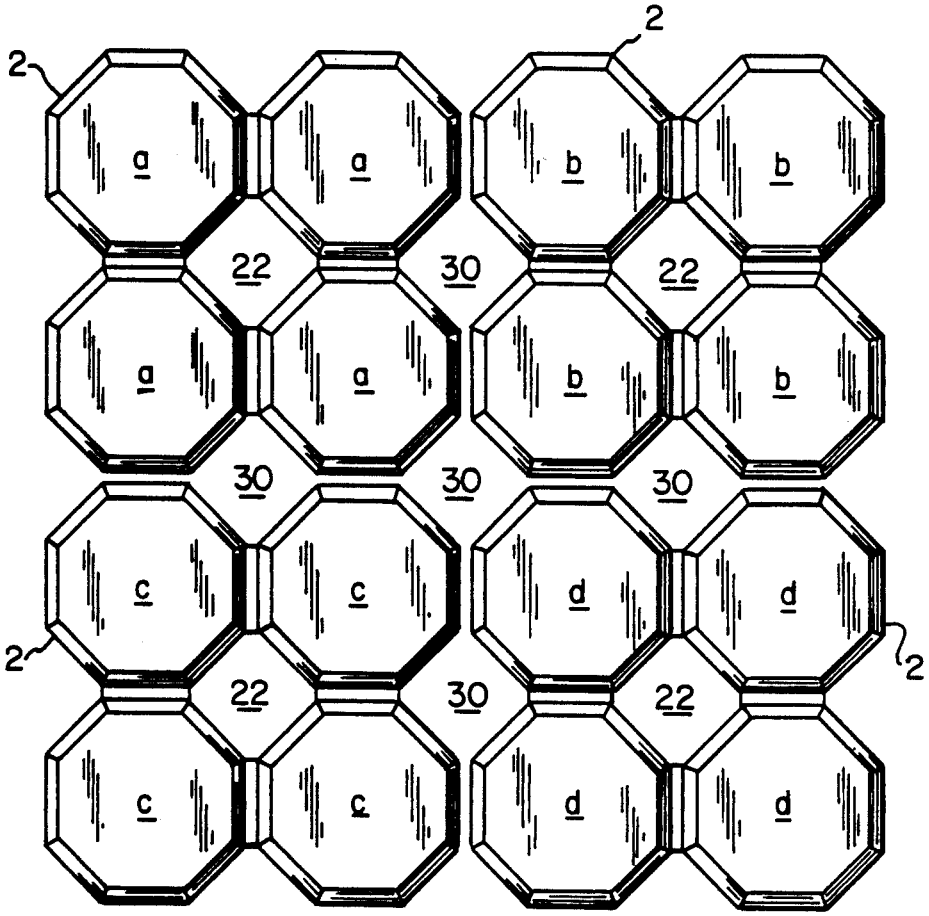
FIG. 6 is a top view of a compound arrangement of a plurality of paving stones of FIG. 1 formed in a stack bond pattern.
Figure 7:
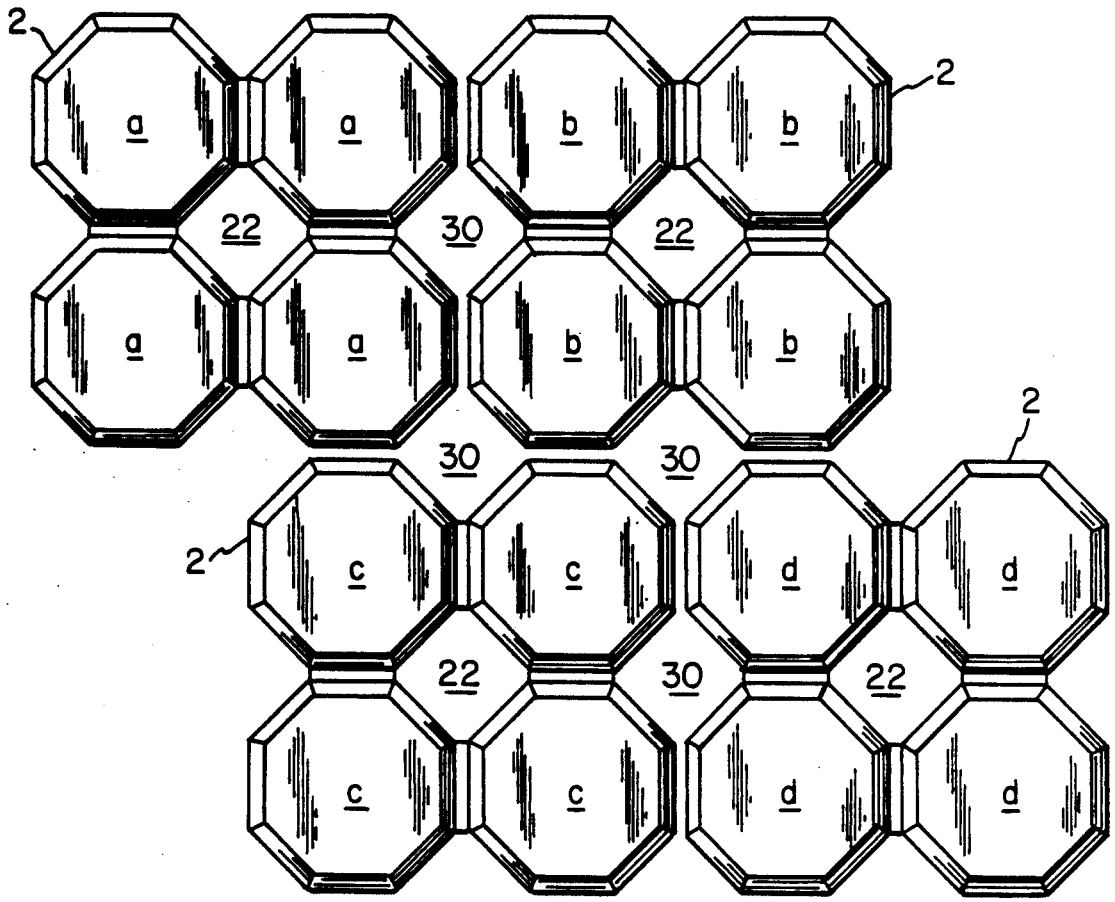
FIG. 7 is a top view of a compound arrangement of a plurality of paving stones of FIG. 1 formed in a running bond pattern.

As shown in FIGS. 1–3 and 5–7, the angled corners 4–7, lateral edges 10–13, v-shaped notches 16–19, hole 22 and recesses 26 of the paving stone 2 are provided with a chamfer 28 at the top surface. The chamfered edges 28 provide improved resistance to damage. The angled corners 4–7, lateral edges 10–13, v-shaped notches 16–19 and central hole 22 may also have a spacer bar extending therefrom to provide a joint of uniform size between adjacent paving stones to provide an appealing appearance to the compound arrangements as shown in FIGS. 6 and 7. Due to the appearance of the chamfers 28 adjacent the groove-like recesses 26, the impression of separate octagons in the compound arrangement is further intensified.

In laying the blocks as shown by FIG. 6, identified as stones 2*a*, 2*b*, 2*c* and 2*d*, the v-shaped notches in the lateral edges of each paving stone are repetitively positioned in registry with corresponding notches in an adjacent matching paving stone to form a first course of paving stones. A second course of paving stones may then be laid in an identical fashion to the first course such that the corners of the matching paving stones of the first course and the corners of matching paving stones of the second course form a square hole 30 between the several abutting paving stones 2 corresponding in dimension to the central hole 22 through any one paving stone to provide a stack bond pattern.

The paving stones 2 may also be laid in a running bond pattern as shown by FIG. 7 and are identified as 2*a*, 2*b*, 2*c* and 2*d*. A first course of paving stones are laid in an identical fashion as in the first course of the stack bond pattern. A second course of paving stones 2 are then positioned in a staggered arrangement to the first course such that the angled corners of adjacent matching paving stones of the second course and the v-shaped notches of paving stones of the first course form a square hole 30 between the several abutting paving stones corresponding in dimension to the central hole 22 through any one paving stone.

Figure 8:
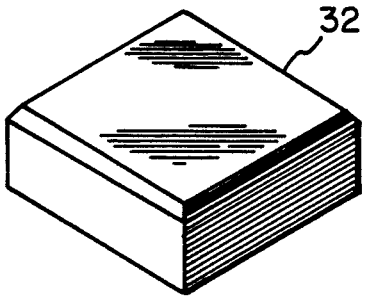
FIG. 8 is a front perspective view of a square paving stone useful in connection with the paving stone of FIG. 1.
Figure 12:
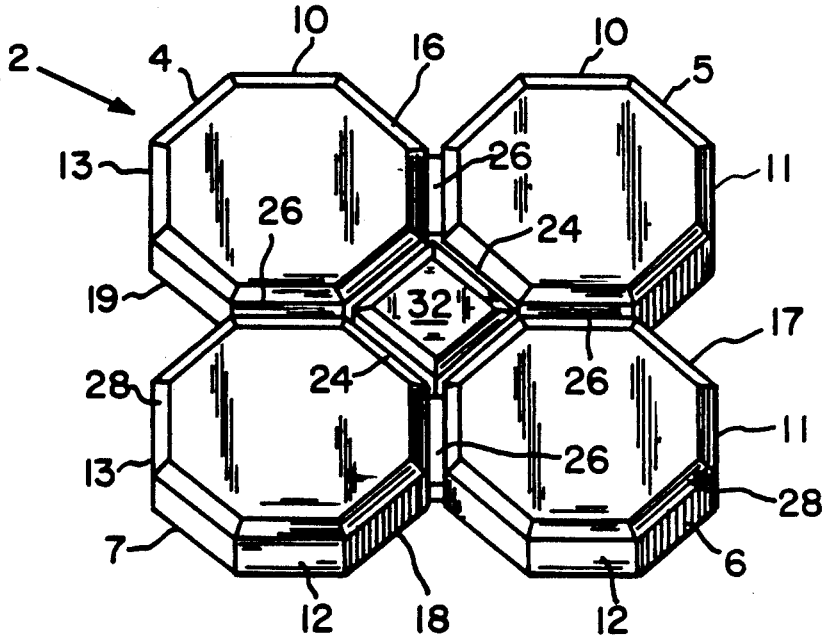
FIG. 12 is a front perspective view of the paving stone of FIG. 1 with the square paving stone of FIG. 8 inserted therein.

The holes 22 and/or 30 may be left void or may be filled in with a square paving stone 32 to provide an interlock arrangement. As shown in FIG. 8 and FIG. 12, a square paving stone 32 having chamfered lateral edges may be positioned within hole 22 of a single paving stone 2 or within hole 30 of several abutting paving stones 2. The square paving stone 32 may be the same color as the paving stone 2 or may be a different color from the paving stone 2 to provide a mosaic effect.

Figure 9:
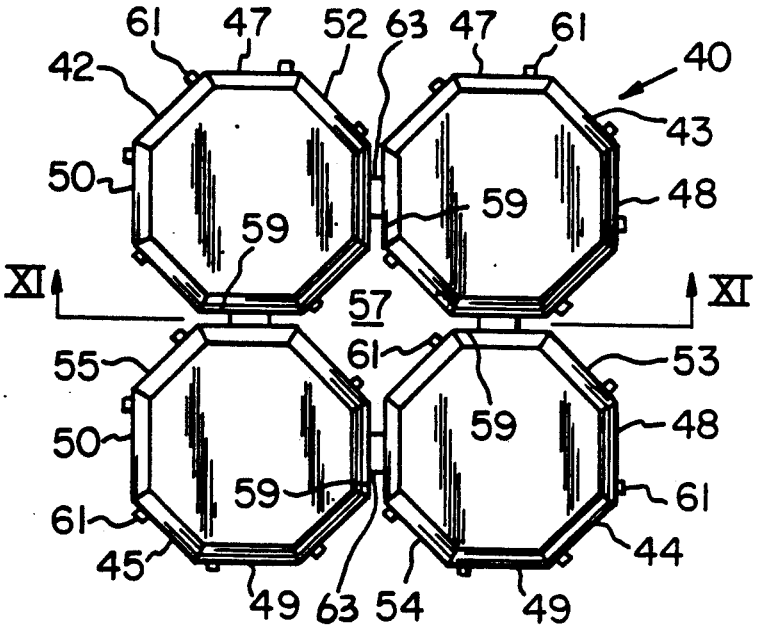
FIG. 9 is a top plan view of a second embodiment of a paving stone in accordance with the present invention.
Figure 10:
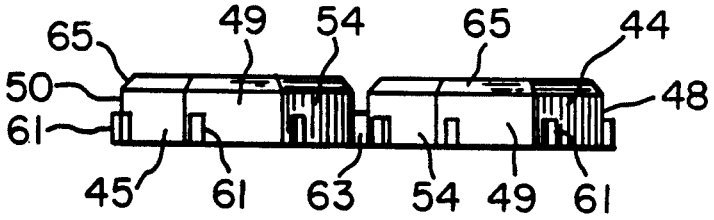
FIG. 10 is a front elevational view of the paving stone of FIG. 9.
Figure 11:
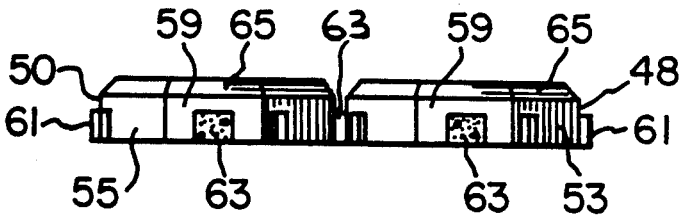
FIG. 11 is a section taken along lines XI—XI in FIG. 9.

A paving stone 40 in accordance with a second embodiment of the present invention is shown in FIGS. 9–11. Paving stone 40 is similar in many respects to paving stone 2 and is generally square-shaped with four angled corners 42, 43, 44 and 45, four lateral edges 47, 48, 49 and 50, v-shaped notches 52, 53, 54 and 55 in each lateral edge, a central square hole 57 and groove-like recesses 59 extending between the corners of the hole 57 and an adjacent v-shaped notch. Spacer bars 61 are shown on the outer surfaces of the angled corners 42–45, lateral edges 47–50, v-shaped notches 52–55 and central hole 57 to provide contact with adjacent stones and provide a uniform spacing therebetween. The spacer bars 61 preferably have a width identical to that of the groove-like recesses 59 and are molded with the stone near its bottom surface. The spacer bars 61 shown in FIGS. 9–11 can also be included on the paving stone 2 shown in FIGS. 1–5.

In accordance with the paving stone 40 in FIGS. 9–11, unlike the paving stone 2 shown in FIGS. 1–5, each groove-like recess 59 extends substantially through the paving stone, leaving a bridging element 63 integral therewith which joins together the four separate octagon portions. This arrangement heightens the visual appearance of four separate octagons in the integral stone 40. As in the paving stone 2 shown in FIGS. 1–5, the paving stone 40 shown in FIGS. 9–11 can include chamfers 65 along all of the top surface edges.

Having described the presently preferred embodiments of the invention, it is to be understood that it may be otherwise embodied within the scope of the appended claims.

I claim:

1. A paving stone comprising a square block including four lateral edges, four corners and a central hole, said central hole being square throughout its cross-section, said four lateral edges each having a notch between said corners of said block such that said central hole has a shape that may be apportioned into equivalent quarter sections, each quarter section a mirror image of a shape of said closest diagonal corner and two combined quarter sections are a mirror image of said notches in said lateral edges.

2. The paving stone of claim 1 wherein said square-shaped central hole is rotated approximately 45° from a line formed by said lateral edges of the paving stone such that said central hole appears as a diamond shape within said square block.

3. The paving stone of claim 2 further comprising a plurality of groove-like recesses extending between the corner of said v-shaped notches and the corners of said central hole such that a paving stone is formed having the appearance of four separate octagons.

4. The paving stone of claim 3 wherein said groove-like recesses extend substantially through said paving stone and said four separate octagons are joined together by a bridging element integral therewith.

5. The paving stone of claim 3 wherein said lateral edges, corners and v-shaped notches are chamfered.

6. The paving stone of claim 5 wherein said groove-like recesses and central hole are chamfered.

7. A paving stone comprising a square block including four lateral edges, four corners and a central hole, said four lateral edges each having a notch between said corners of said block such that said central hole has a shape that may be apportioned into equivalent quarter sections, each quarter section a mirror image of a shape of said closest diagonal corner and two combined quarter sections are a mirror image of said notches in said lateral edges, said paving stone further comprising a block shaped and sized substantially identical to said central hole positioned within said central hole, wherein said block is square-shaped and has chamfered lateral edges.

8. A paving stone comprising a square block including four lateral edges, four angled corners and a central hole, said four lateral edges each having a V-shaped notch between said angled corners of said block, said paving stone further comprising a plurality of groove-like recesses extending between the corner of said V-shaped notches and the corners of said central hole such that a paving stone is formed having the appearance of four separate octagons.

9. The paving stone of claim 8 wherein said central hole is square-shaped.

10. The paving stone of claim 8 wherein said central hole is diamond shaped.

11. The paving stone of claim 8 wherein said lateral edges, corners and v-shaped notches are chamfered.

12. The paving stone of claim 8 wherein said groove-like recesses and central hole are chamfered.

13. The paving stone of claim 8 further comprising a square-shaped block positioned within said central hole.

14. The paving stone of claim 13 wherein said square-shaped block has chamfered lateral edges.

15. The paving stone of claim 8 wherein said groove-like recesses extend substantially through said paving stone and said four separate octagons are joined together by a bridging element integral therewith.

16. A paving stone comprising a square block including four lateral edges, four corners and a central hole, said four lateral edges each having a notch between said corners of said block such that said central hole has a shape that may be apportioned into equivalent quarter sections, each quarter section a mirror image of a shape of said closet diagonal corner and two combined quarter sections are a mirror image of said notches in said lateral edges, wherein said corners are angled, said notches are V-shaped, said central hole is square-shaped and said square shaped central hole is rotated approximately 45° from a line formed by said lateral edges of the paving stone such that said central hole appears as a diamond shape within said square block, said paving stone further comprising a plurality of groove-like recesses extending between the corner of said V-shaped notches and the corners of said central hole such that a paving stone is formed having the appearance of four separate octagons.

17. The paving stone of claim 16 wherein said groove-like recesses extend substantially through said paving stone and said four separate octagons are joined together by a bridging element integral therewith.

18. The paving stone of claim 16 wherein said lateral edges, corners and V-shaped notches are chamfered.

19. The paving stone of claim 18 wherein said groove-like recesses and central hole are chamfered.

* * * * *

UNITED STATES PATENT AND TRADEMARK OFFICE

CERTIFICATE OF CORRECTION

PATENT NO. : 4,997,308

DATED : March 5, 1991

INVENTOR(S) : Robert L. Welling, Jr.

It is certified that error appears in the above-identified patent and that said Letters Patent is hereby corrected as shown below:

On the title page:

Under References Cited FOREIGN PATENT DOCUMENTS
"8041 of 1839 United Kingdom ... 404/41" should read
--8041 8/1839 United Kingdom ... 404/41--.

Column 2 Line 61 "paving, stone" should read --paving stone--.

Claim 16 Line 34 Column 6 "closet" should read --closest--.

Signed and Sealed this

Third Day of September, 1991

*Attest:*

HARRY F. MANBECK, JR.

*Attesting Officer*

*Commissioner of Patents and Trademarks*